US005553349A

United States Patent [19]

Kilström et al.

[11] Patent Number: 5,553,349

[45] Date of Patent: Sep. 10, 1996

[54] VACUUM CLEANER NOZZLE

[75] Inventors: Lars G. Kilström, Täby; Nils T. Lindquist, Farsta; Rolf G. Sjöberg, Kungsängen, all of Sweden

[73] Assignee: Aktiebolaget Electrolux, Stockholm, Sweden

[21] Appl. No.: 383,975

[22] Filed: Feb. 6, 1995

[30] Foreign Application Priority Data

Feb. 21, 1994 [SE] Sweden ..... 9400590

[51] Int. Cl.[6] ..... A47L 9/02

[52] U.S. Cl. ..... 15/360; 15/365; 15/367; 15/371

[58] Field of Search ..... 15/359, 360, 365, 15/367, 371

[56] References Cited

U.S. PATENT DOCUMENTS

| | | | |
|---|---|---|---|
| 1,689,089 | 10/1928 | Teves | 15/371 X |
| 3,497,903 | 3/1970 | Jonsson | 15/371 X |
| 3,659,312 | 5/1972 | Mattsson | 15/371 X |
| 3,660,864 | 5/1972 | Schwatrz | 15/371 X |
| 3,798,704 | 3/1974 | Kilstrom et al. | 15/371 X |
| 3,913,168 | 10/1975 | Lovgren | 15/371 X |

FOREIGN PATENT DOCUMENTS

| | | | |
|---|---|---|---|
| 517250 | 2/1931 | Germany | 15/371 |
| 2145002 | 3/1973 | Germany | 15/371 |

*Primary Examiner*—Chris K. Moore
*Attorney, Agent, or Firm*—Pearne, Gordon, McCoy & Granger

[57] ABSTRACT

A vacuum cleaner nozzle having a first nozzle part (11) which has brush elements (23) or the like facing the floor and a second nozzle part (25) which is movably arranged with respect to the first part (11) and which has at least one suction opening (27) through which air flows to an outlet tube (13) connected to the nozzle. The second nozzle part (25) is supported by the first nozzle part (11) by means of a resilient element (31). The resilient element maintains the second part (25) above the floor when the nozzle is moved on a hard surface and allows the second part (25) to move toward the floor when the nozzle is moved on a soft surface, such as a soft carpet.

14 Claims, 1 Drawing Sheet

VACUUM CLEANER NOZZLE

BACKGROUND OF THE INVENTION

1. Field of the Invention

The invention relates to a vacuum cleaner nozzle which includes a first nozzle part having brush elements facing the floor and a second nozzle part which is movably arranged with respect to the first nozzle part and which has at least one suction opening through which air flows into an outlet tube which is connected to the nozzle.

2. Description of the Related Art

Nozzles of the type mentioned above are commonly known and comprise generally complicated mechanisms for facilitating relative movement between the two nozzle parts and for locking the two parts with respect to each other. When such a nozzle is used on a hard floor it rests on the brush elements, which consist of comparatively stiff bristles, whereas the second part, which forms an inlet part for air and which is made of comparatively hard material, is elevated or maintained above the floor. When such a nozzle is used on soft carpet, the nozzle parts are locked in such a position that the second part of the nozzle with the suction opening rests on the floor. Thus, during use on soft carpet, the brush elements are elevated or maintained above the floor and do not prevent or impede movement of the nozzle on the surface of the carpet.

It is known to use so-called automatic nozzles, as shown by DE 1628474. In automatic nozzles, the brush elements are supported by diaphragms or membranes which are under the influence of one or more springs and the sub-atmospheric pressure prevailing in the outlet tube. When the nozzle is placed or used on a hard floor, the outer portions of the brush elements abut the floor, which means that the central hard part of the nozzle forming the air inlet part is maintained above the floor so that air can flow through the brush elements and into the suction opening of the inlet part. A limited sub-atmospheric pressure prevails in the space above the membranes, but this pressure cannot overcome the spring force. The membranes, and hence the brush elements, remain in their lower position. When the nozzle is used on soft carpet, the brush elements and the supporting wheels on the inlet part and, hence, the complete nozzle will sink down into the carpet. This reduces air flow through the suction opening and increases the sub-atmospheric pressure above the membrane so that the spring force is overcome and the brush elements are lifted up from the surface of the carpet, thereby causing the inlet part to rest directly on the floor.

There also are nozzles in which the functions mentioned above have been integrated or combined so that it is possible to make a choice between using the nozzle as an automatic nozzle or as a nozzle which is manually operated.

A disadvantage with known automatic nozzles is that they are provided with a diaphragm of rubber or plastic which is relatively expensive and complicates the design of the nozzle. Therefore, there exists a need in the art for an automatic nozzle which is simple and inexpensive.

SUMMARY OF THE INVENTION

An object of the present invention is to achieve an automatic nozzle which is less complicated and less expensive than presently known nozzles, the nozzle also having the advantage that it "floats" on a soft floor, i.e., is self-adjusted with respect to the floor. The arrangement according to the present invention also makes possible the use of soft bristles for the brush elements which reduces friction against the floor if the bristles should touch the soft floor.

BRIEF DESCRIPTION OF THE DRAWINGS

An embodiment of the invention will now be described with reference to the accompanying drawings in which.

DETAILED DESCRIPTION OF THE PREFERRED EMBODIMENT

Figure 1:
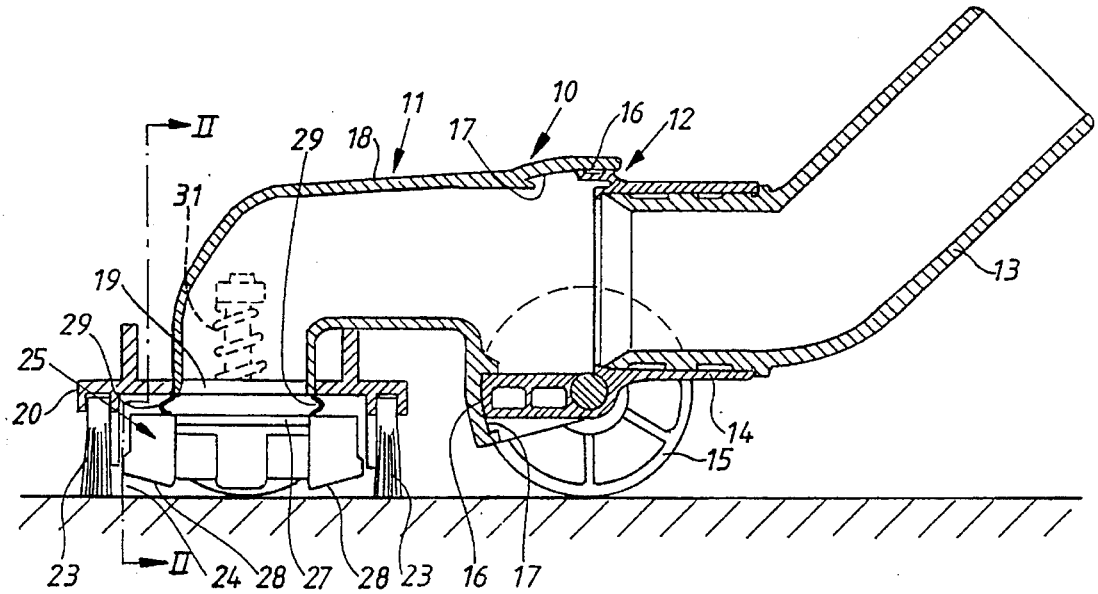
FIG. 1 is a vertical section through a nozzle according to the present invention.

With reference to the drawings, the nozzle 10 comprises a first nozzle part 11 which, via a pivot 12, is connected to an outlet tube 13 to which a tube shaft (not shown) can be fastened in a common way. The pivot 12 comprises a tube-shaped middle part 14 which is fixed on the outlet tube 13 and which is supported by means of a pair of wheels 15 arranged at each side of the outlet tube 13. The middle part 14 includes front sealing surfaces 16 which abut corresponding surfaces 17 on the first nozzle part 11, the two surfaces 16, 17 being movable, within certain limits, with respect to each other when the outlet tube 13 is turned in the vertical plane.

Figure 2:
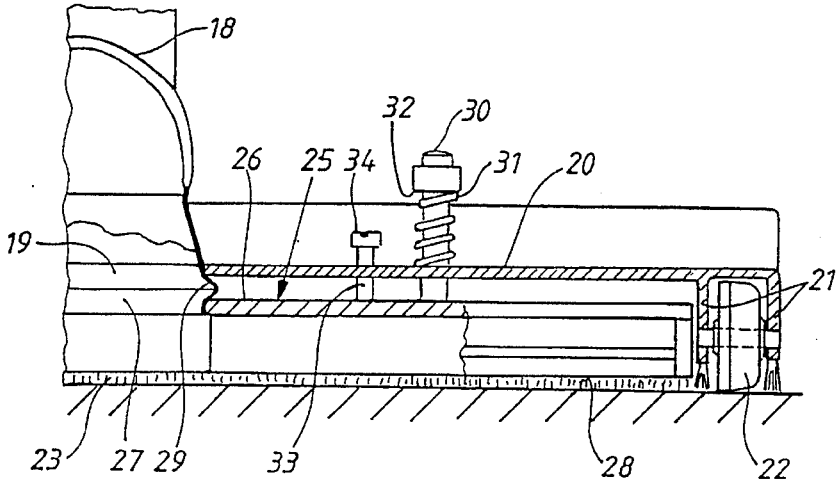
FIG. 2 is a partly broken section on the line II—II in FIG. 1 which shows one-half of the nozzle.

The first nozzle part 11 comprises a central knee-shaped tube portion 18 with a downwardly-directed inlet opening 19. The tube-shaped portion 18 continues into mainly flat portions 20 extending outward at each side of the tube-shaped portion and surround the inlet opening 19. Each end of the flat portions 20 are provided with downwardly directed flanges 21 supporting a wheel 22 therebetween, the axis of the wheel being parallel with the length direction of the nozzle (FIG. 2). At the front and rear edge of the flat portions 20, elongated brush elements 23 with comparatively soft bristles extend downwardly, as illustrated. Bristles may also be provided below the flanges 21. Below the flat portion 20, a space 24 is formed which is circumscribed by the brush elements 23 and the flanges 21.

A second nozzle part 25 is arranged in the space 24 and forms an inlet part for air and comprises an upper mainly rectangular plate 26 at which an elongated profile is arranged. The profile has such a shape that channels are formed through which the air can flow towards a suction opening 27 in the plate 26, the suction opening being in line with the inlet opening 19 on the tube portion 18. The profile also forms relatively glossy sliding surfaces 28 on which the nozzle rests when being moved on a soft floor. The second nozzle part 25 is, via a flexible sealing member 29, sealed from the first part.

On each side of the tube portion 18, the plate 26 of the second nozzle part 25 supports an upwardly extending first element 30 which is freely movable in an opening in the flat portion 20. The first element 30 is surrounded by a helical spring 31 which, at one end, abuts the flat portion 20 and, at an opposite end, abuts a head 32 provided by the first element 30. Near the first element, there is a second upwardly extending element 33 which is also fixed to the plate 26 and which is freely movable in an additional opening in the flat portion 20. This second element has a head 34 which limits downward movement of the second nozzle part 25 with respect to the first nozzle part 11.

The nozzle 10 operates in the following way. When the nozzle is moved on a hard floor, such as wood, tile, or other substantially flat, rigid, non-yielding surfaces, the tips of the brush elements 23 are in engagement with the floor, and the first nozzle part 11 rests on the wheels 22. The spring 31 has a spring force such that the second nozzle part 25 is lifted or elevated above the floor.

When the nozzle is moved across a soft surface, such as a soft carpet, rug, or other yieldable, non-rigid surface, the wheels 22 and the soft bristles will sink down into the carpet, which means that the distance between the second nozzle part 25 and the floor decreases, which results in a larger sub-atmospheric pressure or suction force below the second nozzle part 25. This means that the spring force is overcome, the second nozzle part is sucked towards the floor. When the nozzle is moved on the soft floor it will "float" on the surface, and all the time adjust itself with respect to it.

It should be pointed out that it is possible within the scope of the invention to use other types of spring elements than those which have been described in the embodiment as well as it is possible to desist from the support wheels 22 and the wheels 15. It is also evident that instead of using brush elements, it is possible to use other types of soft materials which do not damage the floor, for instance, rubber or foamed plastic. Therefore, while the preferred embodiment of the present invention is shown and described herein, it is to be understood that the same is not so limited but shall cover and include any and all modifications thereof which fall within the purview of the invention as defined by the claims appended hereto.

What is claimed is:

1. A vacuum cleaner nozzle comprising a first nozzle part (11) which has brush elements (23) facing a floor and defining a space (24) in which a second nozzle part (25) is movably arranged with respect to the first part (11), the second nozzle part having at least one suction opening (27) through which air flows to an outlet tube (13) which is connected to the nozzle, wherein the second nozzle part (25) is supported from the first nozzle part (11) by means of a resilient element (31), and the resilient element is operable to maintain the second nozzle part (25) above the floor when the nozzle is moved on a rigid surface and permits the second nozzle part (25) to move toward the floor when the nozzle is moved on a yieldable surface.

2. A vacuum cleaner nozzle according to claim 1, wherein the second nozzle part (25) is connected to the first nozzle part (11) by a flexible sealing member (29).

3. A vacuum cleaner nozzle according to claim 2, wherein the second nozzle part (25) comprises a plate (26) whose lower side forms an inlet part with channels opening into the suction opening (27), and wherein the suction opening is arranged centrally on the plate and the sealing member (29) surrounds the suction opening.

4. A vacuum cleaner according to claim 1, wherein opposite ends of the first nozzle part (11) are provided with a supporting wheel 22.

5. A vacuum cleaner nozzle according to claim 1, wherein at least one brush element is placed in front of the second nozzle part.

6. A vacuum cleaner according to claim 1, further comprising means (34) for limiting downward movement of the second nozzle part (25).

7. A vacuum cleaner nozzle according to claim 1, wherein at least one brush element is placed behind the second nozzle part.

8. A vacuum cleaner nozzle comprising a first nozzle part (11) and a second nozzle part (25), said first nozzle part (11) being connected to an outlet tube (13) via a pivot (12) with at least one wheel being located near said pivot, said first nozzle part having brush elements (23) facing a floor and defining a space (24) in which the second nozzle part (25) is movably arranged with respect to said first nozzle part (11), said second nozzle part (25) having at least one suction opening (27) through which air flows toward the outlet tube (13), wherein the second nozzle part is supported from the first nozzle part by a resilient element (31), and said resilient element is operable to maintain the second nozzle part (25) above a floor when the nozzle is moved across a rigid surface and permits the second nozzle part (25) to move toward the floor when the nozzle is moved across a yieldable surface.

9. A vacuum cleaner nozzle according to claim 8, wherein the second nozzle part (25) is connected to the first nozzle part (11) by a flexible sealing member (29).

10. A vacuum cleaner nozzle according to claim 9, wherein the second nozzle part (25) comprises a plate (26) whose lower side forms an inlet part with channels opening into the suction opening (27), and wherein the suction opening is arranged centrally on the plate and the sealing member (29) surrounds the suction opening.

11. A vacuum cleaner according to claim 8, wherein opposite ends of the first nozzle part (11) are provided with a supporting wheel 22.

12. A vacuum cleaner nozzle according to claim 8, wherein at least one brush element is placed in front of the second nozzle part.

13. (new) A vacuum cleaner according to claim 8, further comprising means (34) for limiting downward movement of the second nozzle part (25) .

14. A vacuum cleaner nozzle according to claim 8, wherein at least one brush element is placed behind the second nozzle part.

* * * * *